US005294196A

United States Patent [19]

Chen

[11] Patent Number: 5,294,196

[45] Date of Patent: Mar. 15, 1994

[54] TOOL CABINET

[75] Inventor: Chang Chen, Taichung Hsien, Taiwan

[73] Assignee: Tung I Enterprise Co., Ltd., Taiwan

[21] Appl. No.: 77,822

[22] Filed: Jun. 15, 1993

[51] Int. Cl.[5] ..... A47B 47/00

[52] U.S. Cl. ..... 312/263; 312/249.11; 312/218

[58] Field of Search ..... 312/218, 249.11, 249.8, 312/257.1, 263, 265.5, 330.1, 902

[56] References Cited

U.S. PATENT DOCUMENTS

| | | | |
|---|---|---|---|
| 1,733,386 | 10/1929 | Odlin et al. | 312/330.1 |
| 4,379,604 | 4/1983 | Rock et al. | 312/263 |
| 4,880,284 | 11/1989 | Dickson et al. | 312/263 |
| 5,152,441 | 10/1992 | Torena | 312/902 |
| 5,207,723 | 5/1993 | Newby, Sr. | 312/249.11 |
| 5,221,132 | 6/1993 | Combs et al. | 312/902 |

FOREIGN PATENT DOCUMENTS

| | | | |
|---|---|---|---|
| 11797 | of 1902 | United Kingdom | 312/218 |

*Primary Examiner*—Kenneth J. Dorner
*Assistant Examiner*—David E. Allred
*Attorney, Agent, or Firm*—Baker & Botts

[57] ABSTRACT

A tool cabinet includes a bottom wall with a plurality of casters, two vertical opposed side panels connected securely to the bottom wall, a back panel, two door panels mounted pivotally and respectively on front edges of the side panels, a cover member mounted on horizontal upper edges of the side panels, a partition plate and a plurality of drawers. Each side panel has a column of block projections that is formed on an inner panel surface thereof. Each two adjacent block projections cooperatively define a longitudinal groove therebetween. The inner panel surface of each side panel has a first engaging groove adjacent to the rear edge, and a second engaging groove between the rear edge and the first engaging groove. The back panel has two opposed vertical edges which engage respectively the first engaging grooves. The partition plate is mounted on the side panels by engaging aligned ones of the longitudinal grooves. The drawers are mounted on the side panels by engaging remaining aligned ones of the longitudinal grooves. The tool suspending panel has a front surface that is formed with a recess and a tool suspending board on an innermost end of the recess, and two opposed vertical edges that engage respectively the second engaging grooves.

8 Claims, 4 Drawing Sheets

TOOL CABINET

BACKGROUND OF THE INVENTION

1. Field of the Invention

This invention relates to a tool cabinet, more particularly to a tool cabinet which facilitates the storage of tools therein and the retrieval of tools therefrom.

2. Description of the Related Art

Presently, a conventional tool cabinet is provided with a plurality of drawers for receiving tools therein and a tool suspending area for suspending tools thereat. However, the tool suspending area is provided at the innermost end of the tool cabinet behind the drawers. Therefore, the drawers must be removed before the tools suspended at the tool suspending area can be removed or replaced. Moreover, the conventional tool cabinet is inconvenient to manufacture since it is assembled by means of bolts.

SUMMARY OF THE INVENTION

Therefore, the main object of the present invention is to provide a tool cabinet which is constructed to facilitate the storage of tools therein and the retrieval of tools therefrom.

The second object of the present invention is to provide a tool cabinet which can be conveniently assembled.

According to this invention, a tool cabinet includes a bottom wall, two vertical opposed side panels, a back panel, two door panels, a cover member, a partition plate, a plurality of drawers and a tool suspending panel. The bottom wall has a bottom wall surface which has a plurality of casters fixed thereto, and two oppositely disposed peripheral sides. Each of the two vertical opposed side panels has a horizontal lower edge that is connected securely to a respective one of the peripheral sides of the bottom wall, a horizontal upper edge, a front edge, and a column of block projections that is formed on an inner panel surface thereof. Each two adjacent block projections cooperatively define a longitudinal groove therebetween. Each of the side panels further has a vertical rear edge which is opposite to the front edge. The inner panel surface of each of the side panels has a first engaging groove which extends downwardly from the upper edge to the lower edge thereof adjacent to the rear edge, and a second engaging groove which extends downwardly from the upper edge to the lower edge between the rear edge and the first engaging groove. The back panel interconnects the two side panels and has two opposed vertical edges which engage slidably and respectively the first engaging grooves in the inner panel surfaces of the side panels. The two door panels are mounted pivotally on the front edge of a respective one of the side panels. The cover member is mounted on the horizontal upper edges of the side panels. The partition plate is mounted on the side panels by engaging slidably selected aligned ones of the longitudinal grooves of the side panels. The drawers are mounted on the side panels by engaging slidably remaining aligned ones of the longitudinal grooves. The tool suspending panel has a front surface that is formed with a recess and a tool suspending board on an innermost end of the recess, and two opposed vertical edges that engage slidably and respectively the second engaging grooves in the inner panel surface of the side panels.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
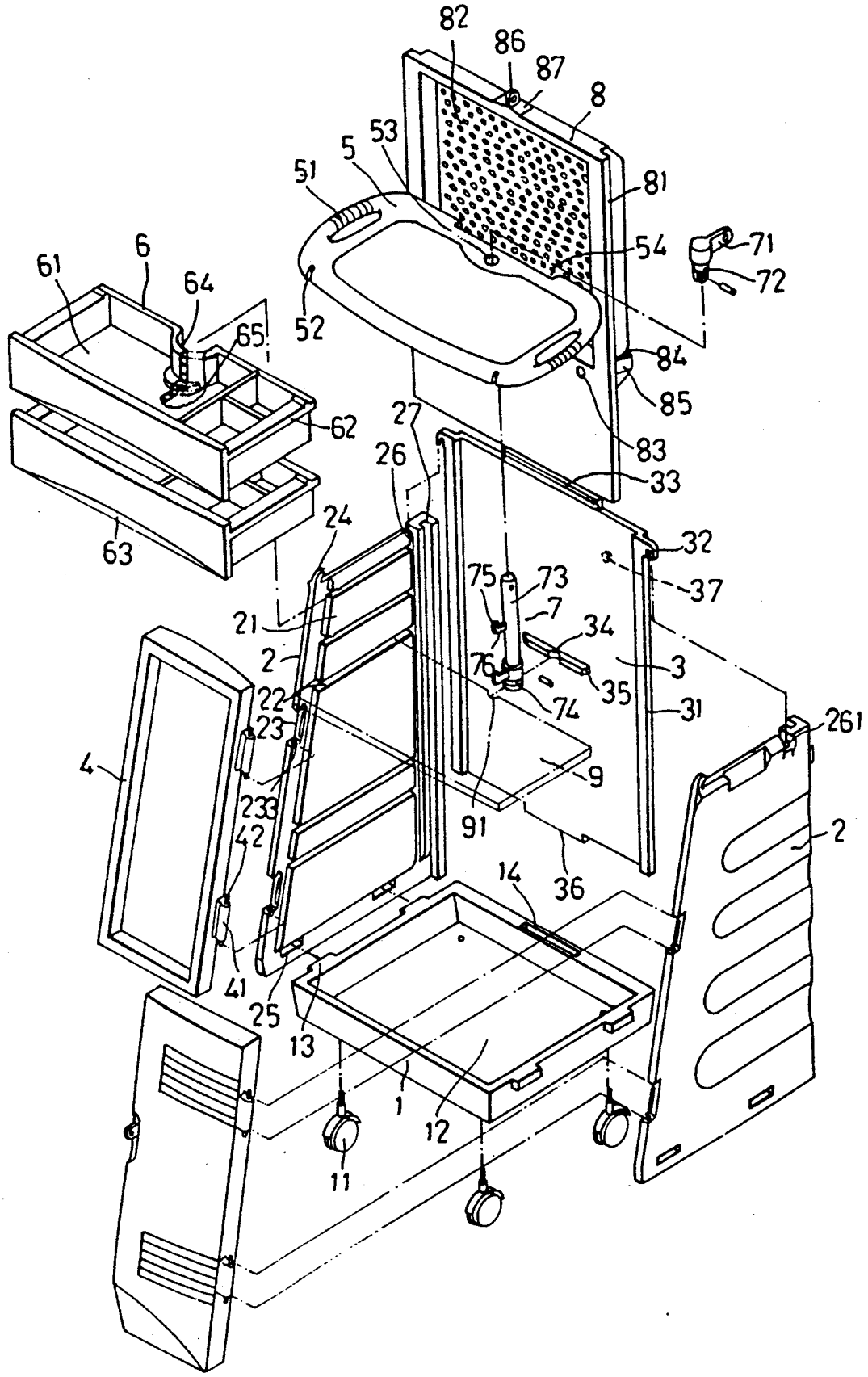
FIG. 1 an exploded view showing a tool cabinet according to a first embodiment of the present invention.

Referring to FIGS. 1, 2, 3 and 4, a tool cabinet according to a first embodiment of this invention includes a bottom wall (1), two vertical opposed side panels (2), a back panel (3), two door panels (4), a cover member (5), a partition plate (9), two drawers (6), a tool suspending panel (8) and a locking assembly (7).

The bottom wall (1) has a bottom wall surface which has a plurality of casters (11) fixed thereto, and two oppositely disposed peripheral sides. Each of the peripheral sides of the bottom wall (1) is formed with two tenons (13). The bottom wall (1) further has a rear peripheral side which interconnects the two oppositely disposed peripheral sides and which is provided with a mortise (14).

Each of the vertical opposed side panels (2) has a horizontal lower edge that is formed with two mortises (25) which engage tightly the tenons (13) of a respective one of the peripheral sides of the bottom wall (1). Each of the side panels (2) further has a horizontal upper edge, a front edge, a vertical rear edge which is opposite to the front edge, and a column of block projections (21) which is formed on an inner panel surface thereof. Each two adjacent block projections (21) cooperatively define a longitudinal groove (22) therebetween. The front edge of each side panel (2) is formed with two pivot notches (23). Each of the pivot notches (23) is defined by a spaced pair of horizontal notch edges and a vertical notch edge extending between innermost ends of the pair of horizontal notch edges. Two aligned blind holes (233) are formed respectively in the horizontal notch edges of each notch (23). Two aligned slits (232) are formed in the inner panel surface of each side panel (2) to access respectively the blind holes (233). A curved fastening hook (24) protrudes upwardly and rearwardly from the upper edge of each side panel (2) adjacent to the front edge of the same. The inner panel surface of each side panel (2) has a first engaging groove (26) which extends downwardly from the upper edge to the lower edge of the side panel (2) adjacent to the rear edge, and a second engaging groove (27) which extends downwardly from the upper edge to the lower edge of the side panel (2) between the rear edge and the first engaging groove (26). The upper edge of each side panel (2) is formed with a thinned retaining portion (261) which is aligned with the first engaging groove (26).

The back panel (3) is made of a flexible material, such as plastic, and has two opposed vertical edges. Two opposed outward flanges (31) project outwardly from the vertical edges of the back panel (3) and engage slidably and respectively the first engaging grooves (26) in the inner panel surfaces of the side panels (2) in order to interconnect the two side panels (2). Each of the outward flanges (31) of the back panel (3) has an upper end which is provided with a hook unit (32) that engages the retaining portion (261) of a corresponding side panel (2). A generally L-shaped fastening strip (33) projects upwardly and frontwardly from an upper end of the back panel (3). The back panel (3) further has a lower edge which is provided with a tenon (36) that engages tightly the mortise (14) of the bottom wall (1), a front surface that is provided with a horizontal protrusion (35) at an intermediate portion thereof, and a rear surface that is formed with a retaining projection (37) adjacent to the upper end thereof. The horizontal protrusion (35) has a curved notch (34) formed in a front end thereof.

The door panels (4) are mounted pivotally on the front edge of a respective one of the side panels (2). Each of the door panels (4) has two pivot lugs (41) which are provided at one side thereof and which are spaced apart and vertically aligned with each other. Each of the pivot lugs (41) has two opposed pivot pins (42) that extend axially from two ends thereof and into the corresponding aligned holes (233) in a respective one of the side panels (2). The pivot pins (42) have a diameter that is wider than the slits (232).

The cover member (5) is mounted on the horizontal upper edges of the side panels (2) and has a front edge which is formed with two slits (52) at two sides of the front edge, and a rear edge which is formed with an elongated groove (54). The fastening hooks (24) of the side panels (2) engage the cover member (5) at the slits (52). The fastening strip (33) of the back panel (3) engages the cover member (5) at the elongated groove (5;. The cover member (5) further has a through hole (53) provided at an intermediate portion of the cover member (5) adjacent to the elongated groove (54) in the rear edge of the cover member (5).

The partition plate (9) is mounted on the side panels (2) by engaging slidably selected aligned ones of the longitudinal grooves (22) of the side panels (2) and is provided with a curved indentation (91) at an intermediate portion of a rear edge of the partition plate (9).

The drawers (6) are mounted on the side panels (2) by engaging slidably remaining aligned ones of the longitudinal grooves (22) above the partition plate (9). Each of the drawers (6) is formed with at least one tool receiving compartment (61) therein and has two opposed sliding flanges (62) which project outwardly from two sides thereof and away from each other to engage the corresponding aligned ones of the longitudinal grooves (22) in the side panels (2). An activating portion (63) is formed on a front side of each of the drawers (6) and is operable to activate the drawer (6). Each drawer (6) has a rear side that is formed with a curved notch (64) at an intermediate portion thereof, and a bottom surface that is formed with a curved groove (65) adjacent to the curved notch (64).

The tool suspending panel (8) is made of a flexible material, such as plastic, and has a front surface that is formed with a recess and a tool suspending board (82) on an innermost end of the recess, and two opposed vertical edges. Two opposed outward flanges (81) project outwardly from the vertical edges of the tool suspending panel (8) and away from each other so as to engage slidably and respectively the second engaging grooves (27) in the inner panel surface of the side panels (2). The tool suspending panel (8) has a retaining blind bore (83) that is formed in the front surface below the recess and that receives releasably the retaining projection (37) of the back panel (3). Each vertical edge of the tool suspending panel (8) adjacent to the rear panel surface is formed with an engaging groove (84) and an engaging plate (85) which engage removably the engaging groove (84). The tool suspending panel (8) further has an upper edge with an intermediate portion (87) which is slightly convex and which has a locking lug (86) provided thereat.

The locking assembly (7) includes a lock head (72) with a pivot arm (71) and an upright cylindrical lock body (73) which has an upper end portion connected to the lock head (72). The lock body (73) extends through the through hole (53) in the cover member (5) and has an annular groove (74) formed in a lower end portion thereof. The annular groove (74) engages the horizontal protrusion (35) of the back panel (3) and the partition panel (9) at the curved notch (34) and the curved indentation (91). Two generally L-shaped locking projections (76) project radially outward from the lock body (73). Each of the locking projections (76) has an upwardly extending outer end portion (75) that engages removably the curved groove (65) in the bottom wall surface of a corresponding drawer (6) so as to secure releasably the corresponding drawer (6) to the back panel (3).

To assemble the tool cabinet, the side panels (2) are connected respectively to the oppositely disposed peripheral sides of the bottom wall (1) in a tight manner by means of the tenons (13) and mortises (25). The back panel (3) interconnects the side panels (2) such as by engaging slidably and respectively the flanges (31) with the first engaging grooves (26) in the side panels (2), while the tenon (36) of the back panel (3) engages the mortise (14) of the bottom wall (1). The fastening hooks (24) of the side panels (2) then engage the cover member (5) at the slits (52), while the fastening strip (33) of the back panel (3) engages the cover member (5) at the elongated groove (54). The lock body (73) of the locking assembly (7) extends through the through hole (53) in the cover member (5) and is positioned by engaging the annular groove (74) with the curved indentation (91) in the partition panel (9) and the curved notch (34) in the back panel (3). The lock head (72) is then connected to the lock body (73) above the cover member (5). The drawers (6) are disposed slidably between the side panels (2) such that the lock body (73) is surrounded by the curved notches (64) in the rear side of the drawers (6) and the back panel (3) and such that the upwardly extending outer end portion of each locking projection (76) is below the curved groove (65) of the corresponding drawer (6). The door panels (4) are then mounted pivotally on the front edge of a respective one of the side panels (2) below the drawers (6). Lastly, the tool suspending panel (8) is disposed slidably between the side panels (2) by engaging the flanges (81) with the respective second engaging groove (27) in the side panels (2).

Figure 4:
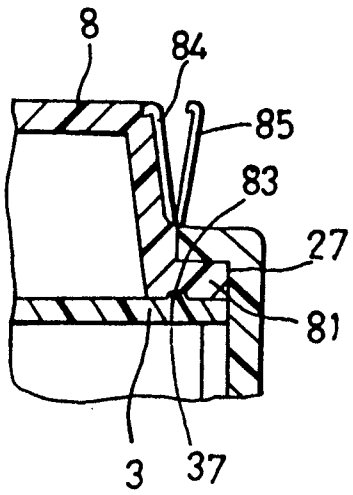
FIG. 4 is a fragmentary sectional view showing the engagement of the retaining projection of the back panel and the retaining blind bore of the tool suspending panel according to the present invention.
Figure 2:
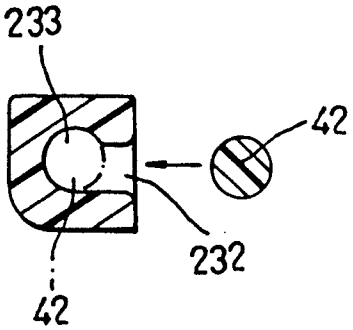
FIG. 2 is a fragmentary sectional view showing one of the blind holes in one of the side panels and one of the pivot pins of one of the pivot lugs of one of the door panels according to the present invention.
Figure 3:
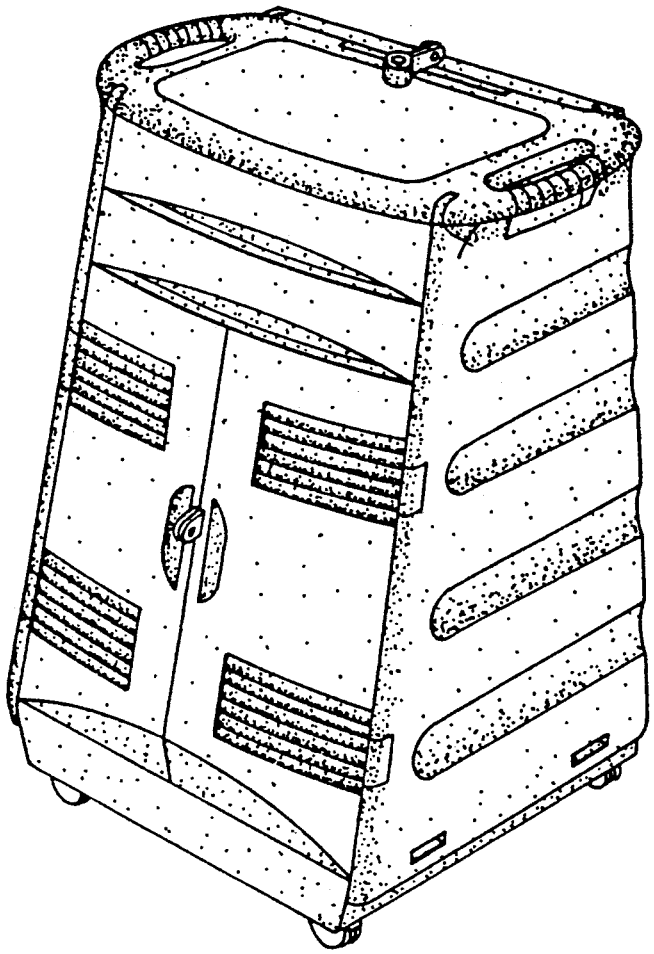
FIG. 3 is a perspective view of the tool cabinet according to the first embodiment of the present invention.

The assembled tool cabinet according to the present invention is shown in FIG. 3. Since the drawers (6) are not covered by the door panels (4), the drawers (6) can be pulled to open the same without the need for opening of the door panels (4). Furthermore, since the intermediate portion (87) of the upper edge of the tool suspending panel (8) is slightly convex, the lock body (73) is moved vertically upward when the pivot arm (71) of the lock head (72) is activated to move toward the locking lug (86) on the tool suspending panel (8) so that the upwardly extending outer end portions (75) of the locking projections (76) engage the curved groove (65) in the bottom surface of the respective drawer (6), thereby locking the drawers (6) and preventing vertical movement of the tool suspending panel (8). To unlock the drawers (6), the pivot arm (71) is moved away from the locking lug (86). At this time, the tool suspending panel (8) can be pulled to move vertically upward until the retaining projection (37) of the back panel (3) engages the retaining blind bore (83) in the front surface of the tool suspending panel (8). The engagement between the engaging plate (85) and the engaging groove (84) in the tool suspending panel (8) permits tight contact between the retaining projection (37) and the retaining blind bore (83), as illustrated in FIG. 4. Thus, a tool can be stored on or retrieved from the tool suspending board (82) of the tool suspending panel (8) conveniently.

Accordingly, the tool cabinet in accordance with the present invention has the following advantages:

1. The tool cabinet is not provided with a tool suspending area at the innermost end thereof behind the drawers (6), and thus, the length of the drawers (6) is not reduced, thereby increasing the capacity of the tool receiving compartments (61) of the drawers (6).
2. The operation of the tool suspending panel (8) is convenient and is independent of the door panels (4) and the drawers (6) so as to facilitate the storage and retrieval of a tool on the suspending panel (8).
3. The operation of the drawers (6) is independent of the door panels (4) so as to facilitate the storage and retrieval of tools in the drawers (6).
4. There is no need to move the cover member (5) from the top of the tool cabinet when a tool is stored in or retrieved from the tool cabinet, and thus, the cover member (5) can function as a working table, thereby making the tool cabinet more effective.
5. The tool cabinet is assembled without the application of locking bolts, thereby reducing the costs and the amount of time required in the manufacture and assembly of the tool cabinet.

Figure 5:
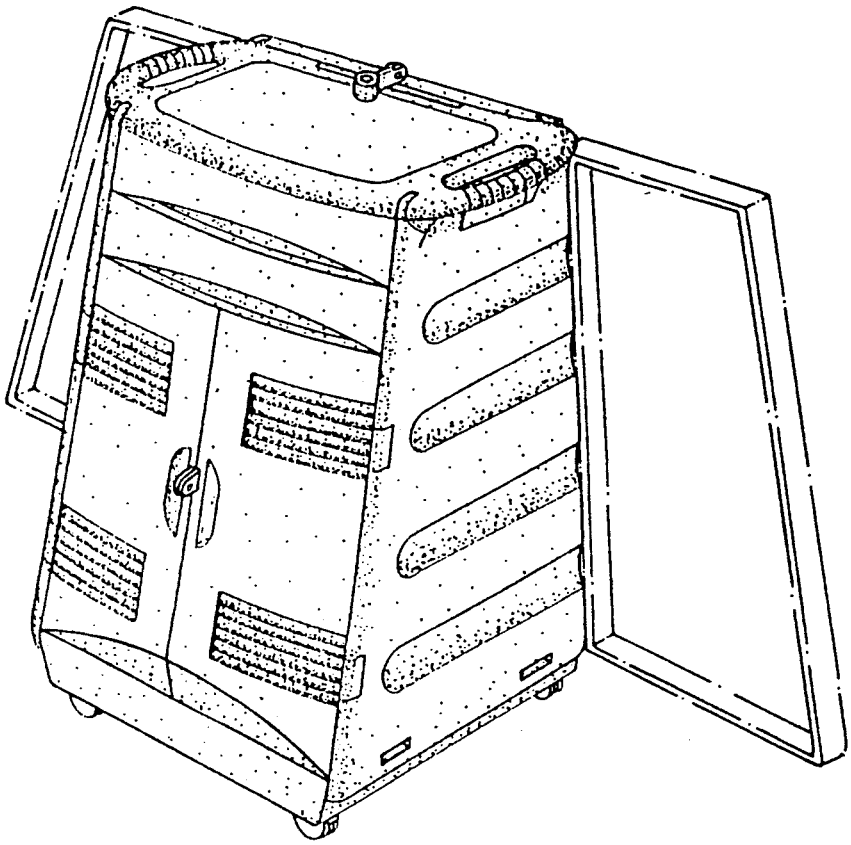
FIG. 5 is a perspective view of the tool cabinet according to a second embodiment of the present invention.

Referring to FIG. 5, a tool cabinet according to a second embodiment of the present invention is shown. The tool cabinet in this embodiment further includes two tool suspending racks (shown in phantom lines) which are connected vertically and pivotally to the side panels (2).

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A tool cabinet including a bottom wall having a bottom wall surface which has a plurality of casters fixed thereto, and two oppositely disposed peripheral sides, two vertical opposed side panels, each of which having a horizontal lower edge connected securely to a respective one of said peripheral sides of said bottom wall, a horizontal upper edge, a front edge, and a column of block projections formed on an inner panel surface thereof, each two adjacent said block projections cooperatively defining a longitudinal groove therebetween, a back panel interconnecting said two side panels, two door panels mounted pivotally on said front edge of a respective one of said side panels, a cover member mounted on said horizontal upper edges of said side panels, a partition plate mounted on said side panels by engaging slidably selected aligned ones of said longitudinal grooves of said side panels, and a plurality of drawers mounted on said side panels by engaging slidably remaining aligned ones of said longitudinal grooves, characterized by:

each of said side panels further having a vertical rear edge which is opposite to said front edge, said inner panel surface of each of said side panels having a first engaging groove which extends downwardly from said upper edge to said lower edge thereof adjacent to said rear edge, and a second engaging groove which extends downwardly from said upper edge to said lower edge between said rear edge and said first engaging groove, said back panel having two opposed vertical edges which engage slidably and respectively said first engaging grooves, said tool cabinet further including a tool suspending panel which has a front surface that is formed with a recess and a tool suspending board on an innermost end of said recess, and two opposed vertical edges that engage slidably and respectively said second engaging grooves.

2. A tool cabinet as claimed in claim 1, further characterized by at least one tenon and mortise joint which connects each of said side panels to said bottom wall.

3. A tool cabinet as claimed in claim 1, characterized in that said front edge of each said side panel is formed with a pivot notch which is defined by a spaced pair of horizontal notch edges and a vertical notch edge extending between innermost ends of said pair of horizontal notch edges, two aligned blind holes being formed respectively in said horizontal notch edges, said inner panel surface of each of said side panels being further formed with two aligned slits to access respectively said blind holes, each of said door panels having a pivot lug which is provided at one side thereof and which has two opposed pivot pins that extend axially from two ends of said pivot lug and into said aligned hole in a respective one of said side panels, said pins having a diameter that is wider than said slits.

4. A tool cabinet as claimed in claim 1, characterized in that each of said side panels has a curved fastening hook protruding upwardly and rearwardly from said upper edge adjacent to said front edge thereof, said back panel having a generally L-shaped fastening strip which projects upwardly and frontwardly from an upper end thereof, said cover member having a front edge which is formed with two slits at two sides of said front edge, and a rear edge which is formed with an elongated groove, said fastening hooks engaging said cover member at said slits, said fastening strip engaging said cover member at said elongated groove.

5. A tool cabinet as claimed in claim 1, characterized in that said upper edge of each said side panel is formed with a thinned retaining portion which is aligned with said first engaging groove, each of said vertical edges of said back panel having an upper end which is provided with a hook unit that engages said retaining portion of a corresponding said side panel.

6. A tool cabinet as claimed in claim 1, further characterized by:

said back panel having a front surface that is provided with a horizontal protrusion at an intermediate portion thereof, said horizontal protrusion having a curved notch formed in a front end thereof, each of said drawers having a rear side that is formed with a curved notch at an intermediate portion thereof, and a bottom surface that is formed with a curved groove adjacent to said curved notch, said partition panel being provided with a curved indentation at a rear edge thereof, a locking assembly including a lock head with a pivot arm and an upright cylindrical lock body which has an upper end portion connected to said lock head, said lock body extending through said cover member and having an annular groove formed in a lower end portion thereof, said annular groove engaging said horizontal protrusion of said back panel and said partition panel at said curved notch and said curved indentation, and a generally L-shaped locking projection which projects radially outward from said lock body and which secures releasably a respective said drawer to said back panel, said tool suspending panel having an upper edge with an intermediate portion which is slightly convex and which has a locking lug provided thereat.

7. A tool cabinet as claimed in claim I, characterized in that said back panel has a rear surface that is formed with a retaining projection adjacent to said upper end thereof, and said tool suspending panel has a retaining blind bore that is formed in said front surface below said recess and that receives releasably said retaining projection.

8. A tool cabinet as claimed in claim 1, characterized in that at least one of said side panels has a tool suspending rack connected vertically and pivotally thereto.

* * * * *